United States Patent [19]

Polidoro

[11] 4,293,297

[45] Oct. 6, 1981

[54] GAS BURNER, IN PARTICULAR FOR LIQUID GASES

[76] Inventor: Aldo Polidoro, Vicolo del Convento, Schio (Vicenza), Italy

[21] Appl. No.: 58,803

[22] Filed: Jul. 19, 1979

[30] Foreign Application Priority Data

Jul. 28, 1978 [IT] Italy ..... 85589 A/78
Nov. 6, 1978 [IT] Italy ..... 85622 A/78

[51] Int. Cl.[3] ..... F23D 13/36

[52] U.S. Cl. ..... 431/286; 431/349; 239/601

[58] Field of Search ..... 431/349, 278, 286; 239/548, 601

[56] References Cited

U.S. PATENT DOCUMENTS

| | | | |
|---|---|---|---|
| 1,105,031 | 7/1914 | Hagemeyer | 431/349 X |
| 1,884,764 | 10/1932 | Lonergan | 431/349 |
| 2,059,360 | 11/1936 | Keith | 431/286 |
| 2,497,476 | 2/1950 | Stadler | 431/349 X |
| 3,285,317 | 11/1966 | Hine, Jr. et al. | 239/601 X |
| 4,179,261 | 12/1979 | Riehl | 431/286 |

FOREIGN PATENT DOCUMENTS

| | | | |
|---|---|---|---|
| 540710 | 12/1931 | Fed. Rep. of Germany | 239/548 |
| 1299103 | 6/1962 | France | 431/349 |
| 301699 | 12/1963 | Netherlands | 431/286 |
| 1189364 | 4/1970 | United Kingdom | 431/286 |

*Primary Examiner*—Samuel Scott
*Assistant Examiner*—Randall L. Green
*Attorney, Agent, or Firm*—Bucknam and Archer

[57] ABSTRACT

A burner is described which comprises a cylindrical body, orifices for the exit of the mixture, the orifices being arranged in groups of slits and being of minimum width and moderate length, set side by side in parallel sub-groups, so as to give rise to fan-shaped flames with a single flame front corresponding to each group. In this manner the noise of the burner is reduced and a great stability of the flame is achieved which makes the flame itself regular. This fact produces advantages both as to uniformity of operation and efficiency of the burner. According to one embodiment of the invention, the first plate of the burner is covered by a second plate which is provided with orifices through which the flames coming from the groups of slits pass.

4 Claims, 6 Drawing Figures

GAS BURNER, IN PARTICULAR FOR LIQUID GASES

BACKGROUND OF THE INVENTION

This invention relates to a gas burner and particularly to burners for liquid gas (liquefied gas), the novel feature of which resides in the fact that the burner is provided with groups of orifices for the exit of the mixture of combustible fuel and air as the primary combustion supporter. The orifices are close together and they have minimum dimensions so that unification of the flame front is achieved. This permits one to avoid vibrations of the flame front and to eliminate a very troublesome factor of acoustic disturbance and at the same time gives rise to flames of greater uniformity and permits to achieve a greater specific combustion yield.

According to a further feature of the invention, it is provided that, when combustible fuel is used which has a low rate of flame propagation, in particular when a flame with a strong flame power is required, a fact which causes a high exit velocity of the mixture of combustible fuel and primary air as combustion supporter, pilot flames are present. The pilot flames issue from an interspace between a perforated outer plate in correspondence to the passage of the flames and the plate of the body of the burner, which is equipped with outflow orifices, the latter being very close together and of minimum dimensions for the passage of the fuel mixture.

The above-mentioned interspace is fed with the mixture of combustible fuel and primary air as combustion supporter, which mixture comes at a low outflow velocity from orifices of reduced cross section, so that a great flame stability is achieved.

As it is known, gas burners of high specific capacity generally are provided with many orifices for the outflow of the gas, each one of the orifices causing an autonomous flame front which is independent of the others. Very often the overflow orifices are joined in groups for the purposes of achieving a satisfactory feeding of the flame with a source of secondary air. However, because of the technological difficulties, the distance between the orifices up to the present has never been reduced to less than 2 mm, so that phenomena of vibration of the flame front occur which produce very troublesome noises, the noises frequently reaching intensities so high that considerable damage is caused in the enclosures where the noises are generated and where they propagate.

SUMMARY OF THE INVENTION

One object of the present invention is to provide a burner which may be dimensioned to have a great flame power, which does not produce any vibration particularly in the range which is perceptible to the human ear. The crux of the present invention resides in providing an arrangement of outflow orifices of minimum dimensions, in homogeneous groups, which orifices are very close together, for instance with a distance of 1.2 mm and a width of 0.5 mm so that fan-shaped flames are formed with a single flame front corresponding to each group. On the basis of the tests which have been carried out it has been found that the burner according to the present invention does not produce appreciable noise, a feature which eliminates acoustical disturbances.

It has also been found that the present invention provides for flame stabilization, a feature which makes the flame itself regular, with the resulting advantage in the uniformity of operation as well as in the yield of the burner.

The pilot flames fed from the lateral interspaces greatly contribute to the stabilization of the principle flames even at a very high flame power. In addition a very substantial advantage is achieved in the fact that an appreciable cooling of the plate of the main body of the burner by the mixture which feeds the pilot flames through the lateral interspaces, results.

BRIEF DESCRIPTION OF THE DRAWINGS

The invention will now be described in greater detail by reference to the attached drawings in two particular embodiments of the invention which are described herein merely by way of illustration.

DESCRIPTION OF THE PREFERRED EMBODIMENTS

Figure 1:
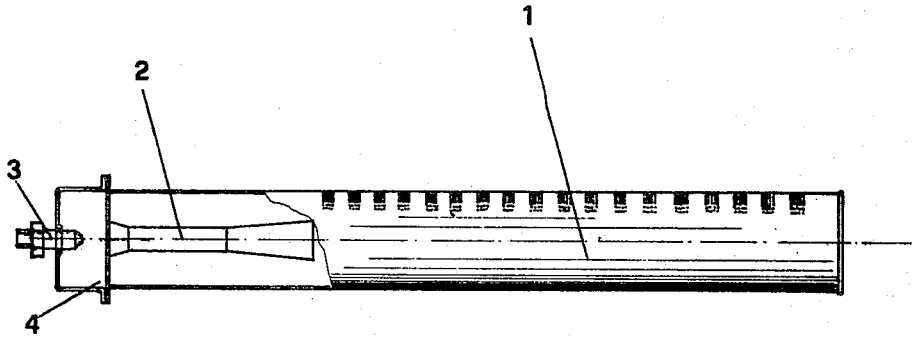
FIG. 1 is an elevational view, partly in cross section of a first embodiment of the burner according to the present invention.
Figure 2:
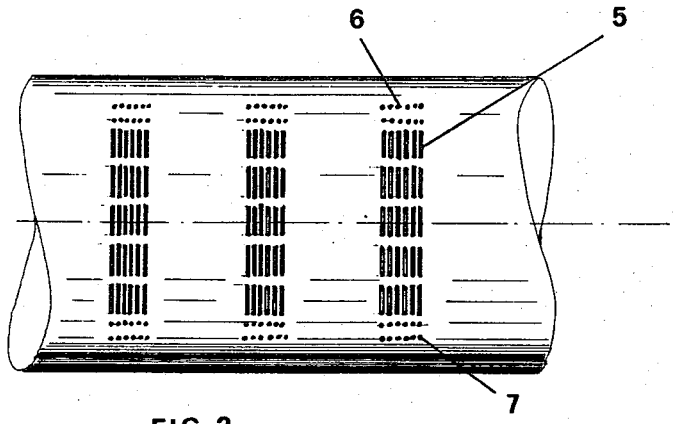
FIG. 2 represents a partial top view of the embodiment of FIG. 1 on a larger scale.
Figure 3:
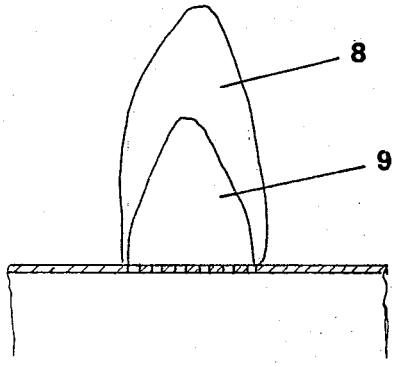
FIG. 3 is a schematic section of the fan-shaped flame corresponding to a group of orifices in the burner according to the invention of FIGS. 1 and 2.

In the first embodiment of the invention illustrated in FIGS. 1–3, the burner comprises cylindrical element 1 which is fed through a "Venturi" tube 2 by nozzle 3 for the outflow of the combustible fuel and by passages 4 for the introduction of the primary source of air which acts as combustion supporter.

In the lateral surface of the cylindrical body 1 are arranged the orifices for the exit of the mixture, which orifices are arranged in groups of slits 5 as shown in FIG. 2 of minimum dimensions in width and of moderate dimensions in length, which slits are further arranged in sub-groups parallel to each other. By way of example and for the purpose of illustration, it is advantageous to specify that each slit may have a width of 0.5 mm and a length of 6 mm with a distance of 1.2 mm and with a distance between the sub-groups of 2 mm, each alignment of the orifices being followed and preceded by groups of pilot orifices designated respectively in the figures by numerals 6 and 7, which pilot orifices stabilize the flames. The groups are spaced from each other, for instance by a distance of 15 mm.

Again for the purpose of illustrating the invention, it is advantageous to specify that the unifying effect of the flame front is achieved, even if in reduced measure, also with a distance between the slits of 1.4 mm and with a width of the slits of 0.7 mm. With this arrangement there is obtained a fan-shaped flame 8 as shown in FIG. 3 of dark blue color, the front part of which, designated by numeral 9 has a luminous blue color. The flame front 9 is a single one for the entire group of orifices, thus resulting in the above-mentioned advantages even in the case when the touch of the primary aeration is very substantial.

Figure 4:
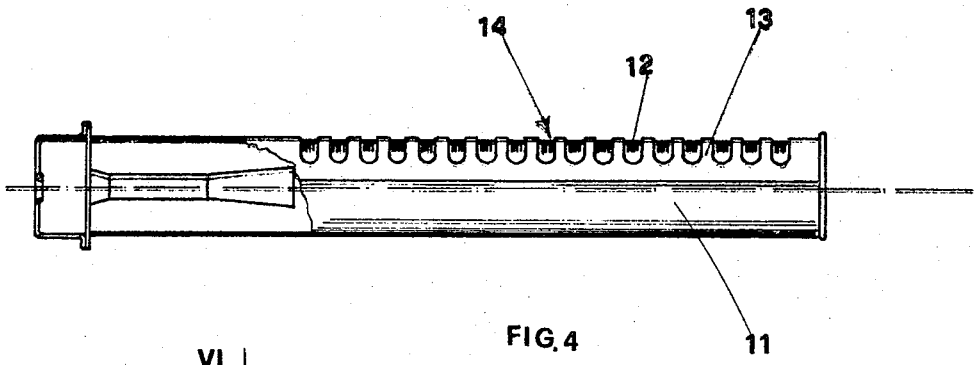
FIG. 4 is a side elevational view, partly in cross section, of a second embodiment of the burner of the present invention.
Figure 5:
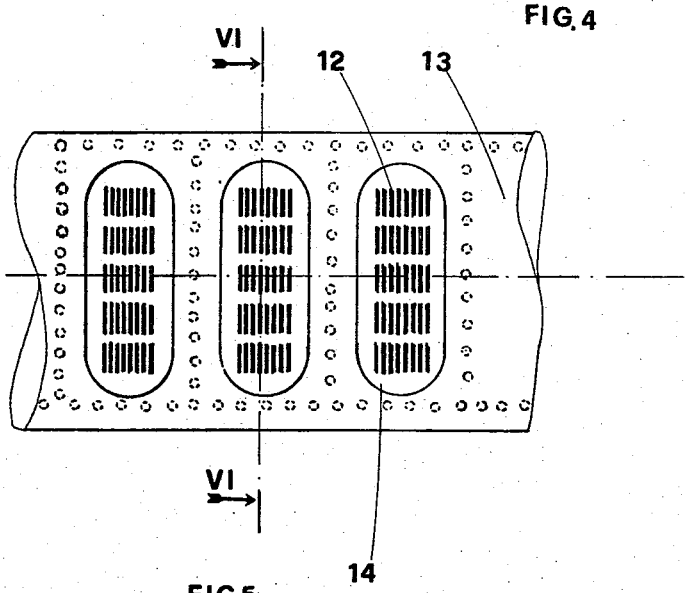
FIG. 5 is a top view, on a larger scale of a part of the burner according to FIG. 4.
Figure 6:
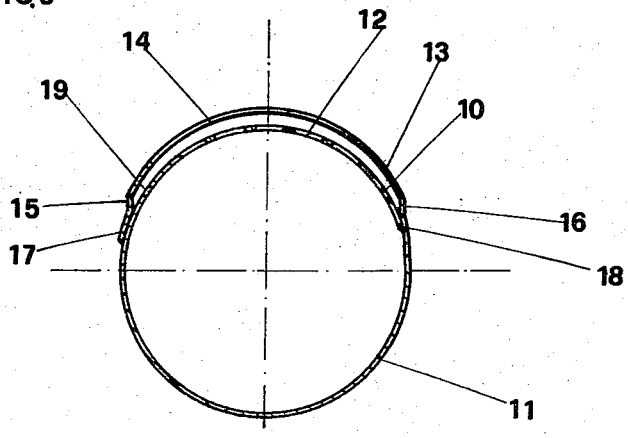
FIG. 6 is a transverse section along lines VI—VI of FIG. 5.

In the second embodiment according to the present invention which is illustrated in FIGS. 4–6, the burner comprises cylindrical body 11 as shown in FIG. 4, which is provided in the top part with groups of slits close to each other, designated by numeral 12 disposed in the upper wall of the burner in accordance with the arrangement described hereinabove in connection with the embodiment of FIGS. 1–3. On the upper surface of body 11 of the burner is soldered plate 13 which is provided with orifices 14 through which pass the flames coming from the individual groups 12 of outflow slits of the combustible mixture.

Advantageously plate 13 may be manufactured from the same plate with which the body 11 of the burner is manufactured as shown in FIG. 6, simply by prolonging the circumferential developments by means of bends 15 and 16 along the sides of the raised section of the plate. In this case the solderings 17 and 18 which may also be carried out by spot welding, are made along the edges of the plate immediately adjacent bends 15 and 16. The orifices 19 and 10 of substantially reduced width, are formed in the underlying part of the plate constituting the body 11 of the burner. They serve to feed the fuel mixture at low outflow velocity in the interspace comprised between plate 11 and plate 13. This mixture feeds the pilot flames which, through the openings 14, lap the sides of the principal flames which come from slits 12. In this manner one obtains principal flames of great stability, the features of which coincide in every other respect with what has been described in the first example of the burner illustrated in FIGS. 1–3.

Another advantage, as it has already been mentioned hereinabove, is due to the secondary effect of the cooling of the upper part of the plate constituting the body 11 of the burner, in particular in the sections adjacent the groups of slits 12 which are lapped by the mixture emanating from the orifices 19 and 10, which mixture advances in the interspace between the plates 11 and 13. In this manner the life of the burner is substantially prolonged.

It is evident that the structural particulars relating to the two embodiments described hereinabove and illustrated in the attached drawings have been given by way of illustration of the invention and are not intended to be limiting because several variations in the details may be carried out without departing from the essential features of the invention, particularly the unification of the flame front corresponding to each sub-group of slits.

What is claimed is:

1. A burner for gas particularly suitable for liquified gas comprising an extended cylindrical tube body, means for supplying the interior of said body through one end thereof with a suitable combustible mixture of gas fuel and primary air, means closing the opposite end of said body, and means forming a plurality of spaced flame fronts in a row along the length and outer surface of said body when the burner is in use, the latter said means consisting along the length of said body of a series of aligned groups of parallel slits penetrating said body to permit flow therethrough of the burning combustible mixture of primary air and gas, all of said slits extending transverse to the length of said cylindrical body, said groups of slits being arranged at a distance apart of 1.4–1.2 mm, each of said slits having a width of 0.5–0.7 mm, said slits being further arranged in sub-groups along an axis transverse to the length of said body and also parallel to each other and being all aligned among themselves, each group being separated from the adjacent groups so as to establish a series of separate flame fronts being fan-shaped to present a unified flame front whereby a substantial reduction in the vibrations produced during the combustion is achieved and substantial stabilization of the flame and improvement in the efficiency of the burner result.

2. The burner according to claim 1 having means forming a chamber outside of said body extending the length of said tube enclosing all of said slits, said chamber consisting of a plate spaced from said body and attached along the edge thereof to said body, said plate provided with an opening opposite each of said groups of slits, the flames from said slits thereby becoming pilot flames for principal flames rising from each opening, whereby the principal flames are strongly stabilized and better cooling of the plate and the body of the burner is achieved.

3. The burner according to claim 1 in which pilot orifices are provided in said body adjacent slots at the outer ends of the outer sub-groups to assist in the stabilization of the flames.

4. The burner according to claim 1 wherein the distance between the slits is about 1.2 mm and the width is about 0.5 mm.

* * * * *